US005862648A

United States Patent [19]

Greenwell et al.

[11] Patent Number: 5,862,648

[45] Date of Patent: Jan. 26, 1999

[54] PARTITION FEEDER

[75] Inventors: J. Daniel Greenwell; Robert M. Kalany, both of Florence, Ky.; Steven F. Mustain, Milford, Ohio

[73] Assignee: R.A. Jones & Co. Inc.

[21] Appl. No.: 831,025

[22] Filed: Apr. 1, 1997

[51] Int. Cl.[6] ..... B65B 35/30; B65B 61/20

[52] U.S. Cl. ..... 53/445; 53/157

[58] Field of Search ..... 53/445, 472, 474, 53/157, 238, 534, 259

[56] References Cited

U.S. PATENT DOCUMENTS

| | | | |
|---|---|---|---|
| 2,615,289 | 10/1952 | Hickin | 53/445 |
| 3,190,048 | 6/1965 | Ganz | 53/445 |
| 3,872,647 | 3/1975 | Langen et al. | 53/157 |
| 4,596,545 | 6/1986 | Greenwell | 493/315 |
| 4,793,117 | 12/1988 | Raudat et al. | 53/157 X |
| 4,896,475 | 1/1990 | McAvinew | 53/259 X |

FOREIGN PATENT DOCUMENTS

| | | | |
|---|---|---|---|
| 142030 | 6/1980 | Germany | 53/259 |

*Primary Examiner*—Linda Johnson
*Attorney, Agent, or Firm*—Wood, Herron & Evans, LLP

[57] ABSTRACT

Partitions are fed from a single magazine by a feeder and are transported in timed mode to two sets of rotary blades which open the partition flaps. The open partitions are carried in a guide work to a nip point between a set of belts which are supported in such a manner that allows their discharge. The motion of the discharge end of the belts is in the direction of the machine direction of the moving bottle pitches and this motion is utilized to follow an insertion point for a time period long enough to insert the partition. The discharge end can then be returned and follow the next gap for insertion of the following partition. A subsequent final seating device insures the partitions are fully engaged with the group of bottles.

26 Claims, 2 Drawing Sheets

PARTITION FEEDER

This invention relates to partition feeders and more particularly to methods and apparatus for feeding partitions between rows of bottles to be packaged together in a carton.

In the past, it has been known to use a constant motion cartoner for packaging a plurality or load of containers in a carton. Where the containers are glass bottles, it has also been known to position partitions between the bottles to help reduce breakage.

For example, where a so-called "12 pack" of glass bottles is to be packaged, three transverse rows of four bottles each are placed into a paper board carton or the like with partitions to help reduce breakage. The partitions typically have fold out segments or tabs for separating adjacent bottles alongside the partition.

Prior cartoning devices, however, typically have at least two problems. One problem resides in the use of material for the partitions. Where the partitions are fed lengthwise parallel to the machine direction of the bottle load conveyor, i.e. between each of the four bottles in a transverse row, three partitions must be used. These equal in total length a total distance of about nine bottle diameters. It is thus one objective to reduce the material necessary to use partitions in a multiple bottle package.

In another aspect of current application difficulties, if it is attempted to insert partitions parallel to the transverse direction, i.e. with two partitions and only three bottle rows of four bottles each, feeding difficulties result. A high speed bottling machine is capable of filling and producing about 1800 or so bottles per minute, translating to about 150 bottle loads or pitches per minute (at 12 bottles per pitch in a 3×4 configuration), in which must be inserted at least two partitions. Since the cartoner is a constant motion cartoner, the window of time open to allow a single partition to be fed from a station into the small gap between bottle rows is very short. And here it is necessary to feed two partitions.

Such short time duration for feeding partitions severely restricts the handling of the partitions upstream and places sometimes impossible feed parameters on the partition feeding operation.

Accordingly, it has been a further objective of this invention to improve apparatus and methods for feeding partitions and to increase the time or window for partition feeding to accommodate high speed constant motion cartoning at a rate of at least up to the range of 1800 bottles per minute or about 150 bottle groups or pitches per minute.

To these ends, a preferred embodiment of the invention contemplates a partition feeder for feeding partitions between bottle rows on a conveyor in a plane transverse to the machine direction of the conveyor. A traveling feeder nip is timed with gaps between the moving bottle rows so that the feeder nip travels along with a first gap between first and second bottle rows for a portion of the gap's motion in the conveyor direction. The nip then returns at least partially upstream then downstream again in timed relation with a second gap between second and third bottle rows. As the nip travels with the gaps, a partition is fed through the nip into the gap between the respective rows. Since the nip travels along with the target gaps, the time window for partition feeding is longer than if the partition had to be fed from a stationary feed position as the gap passes. This allows partition feeding at the relative high speeds of the faster bottling operations and in a continuous cartoning operation for packaging the bottles. Preferably, the traveling nip is driven by a cam configured to follow the first gap, then return and pick up the second gap for a feed duration.

The traveling nip and the extended time window for partition feeding between the bottle rows facilitates upstream partition handling and changeover for different bottle load or pitch configurations and timing. For example, partitions are preferably fed from a magazine by a rotary picker onto a chain conveyor outfitted with lugs for carrying the individual partitions to the upper end of the traveling nip. Where two partitions are to be fed to each load or pitch, i.e. a 3×4 bottle configuration, one partition is laid on the conveyor sequentially after another in equal time spacing or in spacings different than what is finally desired. Yet the conveyor lugs are spaced to pick up the first partition just before the second is deposited, thus arranging the partitions for adjacent gaps closely together and leaving a void, timed with the distance between loads or pitches on the bottle conveyor, between one group of two partitions and the following group of two partitions.

Preferably, the cam driving the nip is in part a function of the bottle pitch spacing and the bottle row spacing within a pitch. The chain conveyor lug spacing and speed are a function of the cam performance so that partitions are fed during the feed window when the nip is operably aligned with a bottle row gap.

For changeover to different configurations, it may only be necessary to change, for example, the cam profile, the feed chain lug spacing and possibly the shape of the plows for turning the fold out segment or tabs as the partitions move along the feed conveyor. Changeover may not require a particular change in any of these parameters.

In another alternative embodiment, a second traveling feed nip may be used with a diverter for one of the partitions moving along the feed conveyor. Each feed nip is driven then to feed one partition onto one gap in a bottle load or pitch, thereby even further extending the duration of the feed window when the nip is operationally aligned with a gap for partition feeding. This advantage is attained since each feed nip can stay with a gap longer than if it also had to track a second gap.

Moreover, it will also be appreciated that one or more of the nips can be operated to feed a partition into a row gap when moving in the downstream conveyor direction or on the return while still aligned with a gap.

These and other alternatives and advantages of the invention will be readily apparent from the following written description of a preferred embodiment of the invention and from the drawings, in which.

Figures 1, 2:
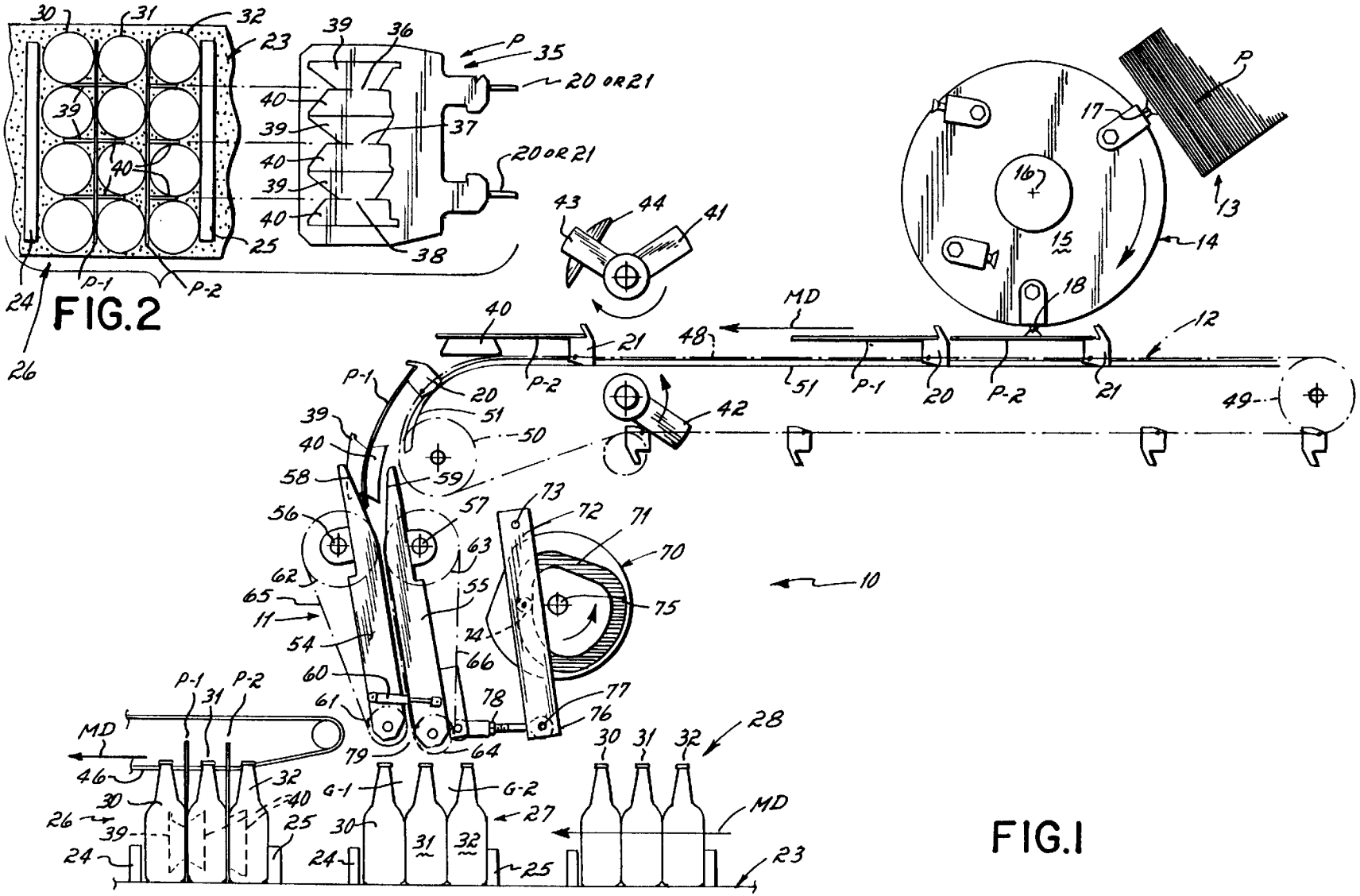
FIG. 1 is a diagrammatic elevational view of a partition feeder according to the invention.
FIG. 2 is a top plan view of a pitch of bottles showing how the partitions reside between the bottle rows and showing to the right a projected plan view of a partition.

Turning now to the drawings, there is shown in FIG. 1 a partition feeder 10 according to the invention. The partition feeder 10 includes a traveling partition feeder 11 disposed in operative conjunction with a partition chain conveyor 12. The partition chain conveyor 12 is positioned to receive partitions "P" from a single magazine 13 (although plural magazines could be used). The partitions "P" are fed individually from the magazine 13 to the chain conveyor 12 by an orbital or rotary feeder 14, for example, or by any other suitable device.

The particular orbital feeder diagrammatically displayed in FIG. 1 includes a rotating wheel 15 mounted about an axis 16 and having a plurality of suction cups, such as at 17 and 18, for picking a partition "P" from the magazine 13 and delivering the partition to the chain conveyor 12.

The chain conveyor 12 is provided with a set of a plurality of lugs, such as leading lug 20 and trailing lug 21. In FIG. 1, suction cup 18 is depicted as depositing a partition in the area immediately preceding the trailing lug 21. As will be further described, this would be the second partition fed into the second gap between second and third bottle rows.

It will be generally appreciated that the chain conveyor is disposed in operative configuration with the traveling partition feeder 11 so that partitions are fed from the chain conveyor 12 to the partition feeder 11, which then feeds the partitions directly into and between rows of bottles on the bottle conveyor 23 in a manner as will be described.

Further, with respect to the bottle conveyor 23, it will be appreciated that the conveyor is outfitted with lugs, such as at 24 and 25, respectively, leading and trailing a group or pitch of bottles as shown in the figures. In this regard, and for example, in FIG. 1, there are three bottle groups or pitches shown, 26, 27 and 28. One of these pitches is shown in plan view in FIG. 2 and comprises three rows 30, 31 and 32 of bottles extending transversely across conveyor 23, each row having four bottles therein.

A first partition "P-1" has been inserted between rows 30 and 31 and a second partition "P-2" has been inserted between second row 31 and third row 32 of bottles. It will be appreciated that the partitions lie transversely in a plane across the conveyor 23.

Turning now again to FIG. 2, one of the partitions is shown in plan view, to the right hand side of FIG. 2, being projected from the partition shown on the left hand side of that figure. The partition "P" includes a paper board partition 35 scored to form foldouts from the body of the partition about fold lines 36, 37 and 38. Tabs are disposed about each line and comprise a forward and a rearward fold out tab 39 and 40.

Each foldout turns about the score lines or fold lines 36, 37 and 38 respectively, so that the forward foldout tab 39 moves forwardly of the partition and the rearward foldout tab 40 moves rearwardly of the partition, both being rotated 90° about the respective fold lines 36, 37 or 38, as shown in plan view for the partition "P-1" in FIG. 2. This is accomplished as the partitions move along the chain conveyor 12 at a plow point or fold point, illustrated by the lugs 41 and 42, which rotate against the partitions to cause them to fold in the manner described.

While the partitions are preferably identical, it will be appreciated that it is not necessary for the second partition to have a forward or downstream extending foldout tab, since the spacings between the bottles of row 31 are filled by the rearward foldout tabs 40, for example, of the lead partition "P-1". Accordingly, when the partitions move down the chain conveyor 12, a first partition, such as that pushed by leading lug 20, for example, will be engaged by the lugs 41 and 42 to fold the rearward and forward foldout tabs 39 and 40 in an appropriate manner so that when the partition "P-1" is inserted between the first and second bottle rows 31 and 32, the foldout tabs 39, 40 extend between the separate bottles of each row.

When the second partition "P-2", however, is moved down the chain conveyor 12, it is engaged on one side by a lug such as 42 but on the other side by lug 43 which has a crescent-shaped member 44 for preventing the forward folding out of the forward foldout tabs 39. Accordingly, the second partition "P-2" will be converted so that only the rearward foldout tabs 40, for example, are folded rearwardly to extend between the separate bottles in the third bottle row 32.

Returning now to FIG. 1, it will be appreciated that the three bottle pitches 26, 27 and 28 bear different spacial relation to the feeder 11. For example, pitch 26 has been provided with partitions "P-1" and "P-2" by the feeder 11 and is moved downstream in the machine direction as indicated by the arrow "MD". A belt having a lower run 46 moving in the machine direction is utilized to position and urge the partitions downwardly to their fully inserted position, in the event that the partition is either not already at that position as a result of its feed, or has engaged the conveyor and bounced back or returned slightly upwardly.

The second pitch 27 is now disposed directly under the feeder 11 and the feeder is in a position to begin to track a gap between the bottles in the first and second rows 30, 31, in order to feed a partition "P-1" therebetween. A second partition "P-2" shown on the chain conveyor 12 and at the lefthand end will be moved around to feed into a second gap between the bottles and second and third rows 31, 32, as will be hereinafter described.

A third pitch 28 comprising three rows across the conveyor of four bottles each is also shown in FIG. 1 moving in the machine direction and the partitions "P-1", "P-2" shown immediately beneath the orbital feeder 14 or conveyor 12 will eventually be fed into this pitch as it moves also in a downstream direction of arrow "MD".

Turning now to more details of the components shown in FIG. 1, any suitable magazine 13 or group thereof may be utilized as well as any suitable feeder for delivering partitions from a magazine such as magazine 13 to the chain conveyor 12. Preferably only one magazine is used. In FIG. 1, there is shown an orbital feeder and magazine as partially described above and which are described in more detail in applicant's own U.S. Pat. Nos. 4,596,545 and 4,518,301. Those patents and their full disclosures are expressly incorporated herein by specific reference thereto for background purposes. It will be appreciated that any suitable feeder could be utilized.

With respect to chain conveyor 12, it will also be appreciated that the conveyor includes preferably two chains 48 entrained about end sprockets 49, 50 (only one each being shown) and carrying adjacent lugs 20 and 21 for example. The lateral or transverse spacing of these lugs, with respect to the partitions in plan view, are illustrated at the righthand side of FIG. 2, for example.

The end sprocket 50 cooperates with the conveyor guide 51 to orient the chains and the lugs 20, 21 to deliver partitions "P-1" and "P-2" for example, to the feeder 11. Appropriate guides may be used to feed the partitions down into the feeder 11, such guides not being shown in the figures for clarity.

It will be appreciated that the leading and trailing lugs 20, 21 on the conveyor are spaced closely together for handling partitions "P-1" and "P-2" for feeding into a single pitch of three rows of bottles, for example. On the other hand, it will be appreciated that there is a significant spacing differential between the trailing lugs 21 and the next leading lugs 20, to allow for and to accommodate the difference in spacing on the conveyor 23 of the various bottle pitches. Thus, while the leading and trailing lugs 20, 21 may be closely spaced together to receive partitions for feeding into adjacent gaps in the same pitch, there may be a longer spacing between a set of lugs 20, 21 and the next set of lugs 20, 21 to accommodate the particular spacing between pitches of bottles on conveyor 23.

In this regard, it will also be appreciated that the orbital feeder 14 is utilized at a constant speed to deliver partitions to the chain conveyor 12. The first partition for each group may be delivered to the chain conveyor and simply placed on a support where it awaits the next lead lug 20 moving along the conveyor 12. As soon as the lead lug 20 passes the feed station, a further partition is fed by a following suction cup on the orbital feeder.

While the orbital feeder might be utilized to feed a plurality of partitions from a magazine, the suction cups are arranged and operated so that only the correct number of partitions are fed to the chain conveyor in the timing and spacing required. Sequential or alternate cups, and/or the selective operation of the cups, can be used to feed the proper number of partitions in the proper spacing.

Thus, in a four suction cup orbital feeder such as that diagrammatically illustrated in FIG. 1, it may only be necessary to utilize two of the suction cups, such as 17 and 18 to actually feed partitions, while the other suction cups may be rendered inoperable, thereby facilitating the indexing of the partition feeds with the spacing of the lugs on the conveyor and ultimately with the gaps between the bottle rows and the bottle pitches on conveyor 23.

The partition feeder 11 includes two frame members 54, 55, each pivoted near their upper ends at pivot points 56 and 57 respectively. Each of the frame members 54, 55 has respective upper guides 58, 59, which open outwardly and upwardly as shown, for receiving the partitions therebetween.

The frame members 54, 55 are connected at their lower ends by an adjustable or spring loaded connector 60, of which there are preferably two, one on each side of each respective frame 54, 55. The connector 60 may comprise an adjustable rod or a spring loaded interconnector holding the bottom ends of the frames 54, 55 together.

It will be appreciated that frames 54, 55 may comprise relatively thin frame members and that there are two or more of these frame members on each side of the feeder 11, only one being shown in each side in the various figures here, for clarity. Respective rollers 61, 62, 63 and 64 are mounted for rotation at upper and lower ends of the respective frame members 54, 55 and these rollers support respective belts 65, 66 comprising rotating members entrained about the respective rollers to form a nip therebetween.

At least one of the rollers on each side of the feeder 11 is driven so that the belts 65, 66 comprise rotating members which have facing runs comprising a partition nip for gripping partitions therebetween and moving them downwardly from the chain conveyor 12 toward and into the bottle pitches on the conveyor 23.

The belts 65, 66 may be driven at a speed faster than the linear speed of the partitions on the chain conveyor 12, so as to shoot the partitions into the pitches and between the respective bottle rows. Even where there is no pre-formed gap between the body of the bottles, the speed of the partitions is sufficient to allow the partitions to be inserted between the bottle rows and this could occur even when the bottles are slightly nested or off center in the respective rows, for example.

The traveling partition feeder 11 is driven by a cam 70 having a cam track 71. A lever 72 is pivoted at 73 and carries a cam follower 74 which is translated by the rotating cam 70 and the cam track 71 as it rotates about the cam axis 75.

The lower end 76 of the lever is pivoted at 77 to an adjustable connector arm 78. The arm 78 is connected to at least one of the frame members of the traveling nip 11, such as frame number 55, for example.

Since the frame members 54, 55 are pivoted at their upper ends about pivots 56, 57, and since the lower ends of the frame are connected by the connector 60, rotation of the cam 70 and the resulting movement of the lever 72 causes the lower discharge end or outlet 79 of the traveling feeder to move backwardly and forwardly in the machine direction indicated by the arrow "MD" for example.

Accordingly, the traveling feeder 11 comprises a partition nip or traveling feed nip having a traveling partition outlet end, such as at 79, and operable to discharge partitions between the bottle rows and the pitches on conveyor 23.

Turning now to a description of the partition feeding operation, attention is directed to FIGS. 1 and 3A–3C. In FIG. 1, it will be appreciated that the feeder 11 is moved rearwardly in an upstream direction, the cam follower 74 lying in a portion of the cam track 71 most closely adjacent the cam axis 75.

In this position the feeder 11 is indexed with a gap "G-1" between the necks of the bottles in the rows 30 and 31, respectively. It will be appreciated there is another gap "G-2" between the necks of the bottles and the second row 31 and the third row 32.

At the time indicated in FIG. 1, however, the traveling partition outlet or discharge end 79 is indexed with the trailing edge of the gap "G-1" and the cam is rotated as the conveyor 23 moves the pitch of bottles 27 in the direction of arrow MD in a downstream direction.

Figures 3A, 3B, 3C:
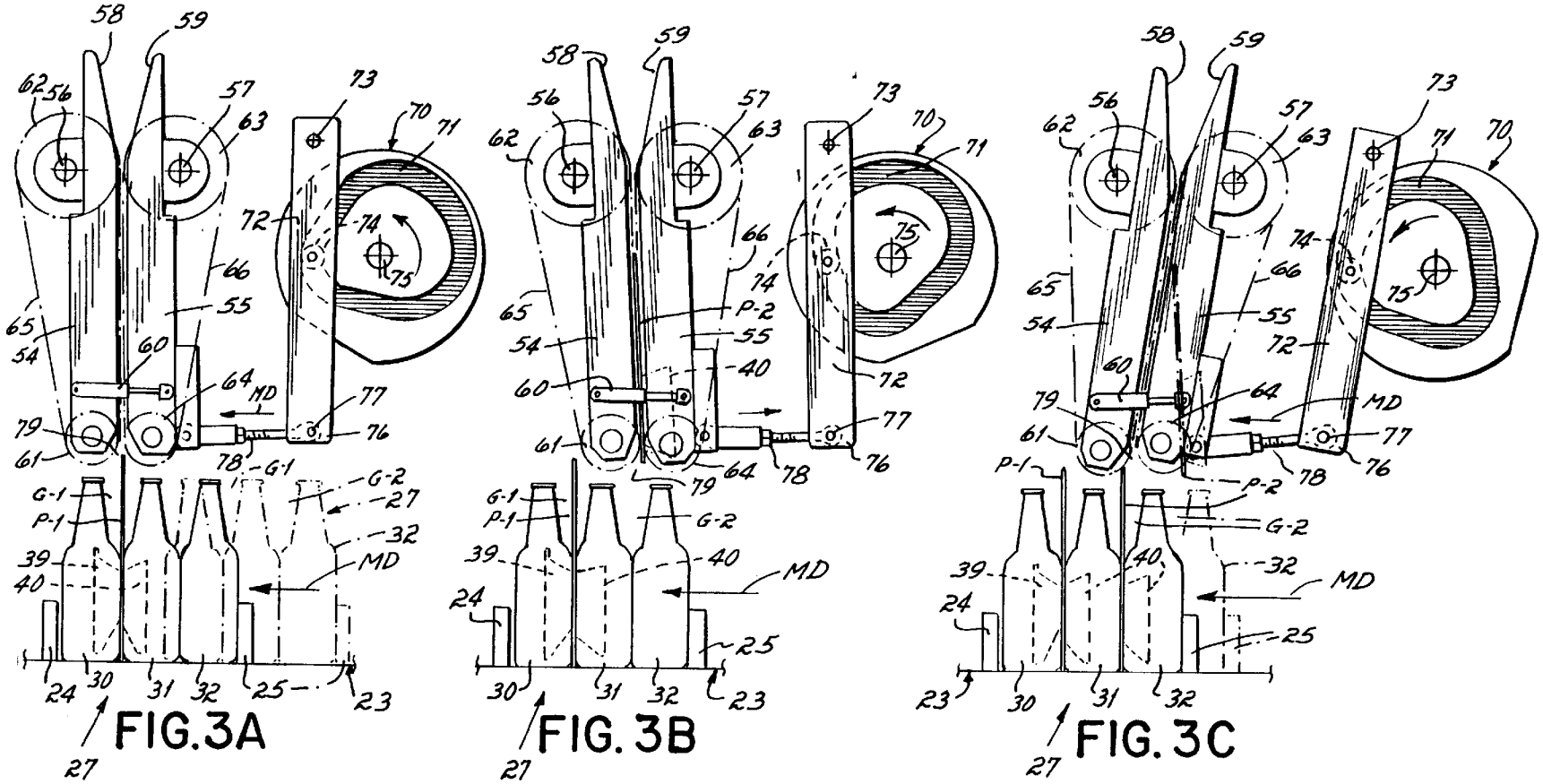
FIG. 3A is an abbreviated elevational view like FIG. 1 but showing a first partition having been fed into a gap between first and second bottle rows.
FIG. 3B is a view similar to FIG. 3A but showing the feeder returning to index with a second gap between bottle rows two and three.
FIG. 3C is a view similar to FIG. 3B but showing the second partition having been fed into the second gap and the motion of the feeder between first indexing with the second gap and after the second partition feeding therein.

This rotation is illustrated in FIG. 3A, where the cam follower 74 is now located in the cam lobe such that the lever 72 is pivoted to move the traveling partition outlet 79 in a downstream direction following or tracking the gap "G-1" between the bottle rows 30 and 31.

During this travel, a partition "P-1", which is shown on the leading lug 20 of FIG. 1 just entering the diverging open end 58, 59 of the feeder 11, has been gripped by the nip formed by the belts 65, 66 and inserted downwardly into the gap "G-1" in between the bottles of the first and second rows 30, 31. This is done, of course, as the bottles move in the direction MD on the conveyor 23 in a dynamic state.

For purposes of understanding the invention, looking at FIG. 3A it will be appreciated that the pitch 27 of bottles, as shown in FIG. 3A, has moved to that position from the prior position of the bottles, shown by the dotted line 27, so that the gap "G-1" has moved from its dotted line position to the solid line position, all as illustrated in FIG. 3A.

Turning now to FIG. 3B, the partition "P-1" has been inserted in the gap "G-1" and the bottles have continued to move downstream in the machine direction on the conveyor 23.

At the same time, the cam 70 and cam track 71 have rotated to withdraw or move the lever 72 in an upstream direction and thus have moved the traveling partition outlet 79 upstream to a position where it indexes with the gap "G-2" between the second and third rows, 31, 32 of bottles.

At this time, it will be appreciated that the second partition "P-2" has been inserted by the chain conveyor 12 (not shown) into the traveling feeder 11 and that the partition has begun to move downwardly toward the gap "G-2" as that gap moves in the machine direction MD.

In FIG. 3C, the partition "P-2" has been inserted between the bottles at rows 31, 32 and the pitch 27 has continued to move downstream in the machine direction on conveyor 23. FIG. 3C indicates, in dotted lines, the immediately preceding portion of the last row 32 of bottles in the pitch 27, as it was depicted in FIG. 3B, where the traveling partition outlet 79 just began to index with the gap "G-2". In FIG. 3C, the gap "G-2" is shown having moved downstream with the traveling partition outlet 79 moving downstream with the gap "G-2" and creating a time window for feeding a partition "P-2" between the bottle rows 31, 32.

As the pitch 27 continues to move downstream, and returning momentarily to FIG. 1, it will be appreciated that the pitch is moved under one or more belts 46 for the purpose of moving the partitions "P-1" and "P-2" downwardly into their bottom seating position and holding them there as the bottles are transferred downstream for cartoning in a carton, for example, in a conventional cartoner. In this regard, the bottles may be pushed longitudinally in the direction of the rows laterally and across the conveyor 23 into a cartoner or further bottle group receiving bucket for further cartoning.

It will also be appreciated that the partition "P-1" has a forward folding tab 39 and a rearward folding tab 40. That is to say at least three of these extend between the respective bottles in the first and second rows 30, 31 as shown in FIG. 2, and as shown by the dotted lines in FIG. 3A.

The partition "P-2" has been inserted as shown in FIG. 3C. It will be noted that the rearward tab 40 is shown by the dotted line there and indeed three of such tabs are inserted between the four bottles in the third row 32. The partition's various tabs thus tend to separate the bottles and substantially reduce their engagement of glass on glass and bottle breakage and damage.

Having now described the preferred embodiment of the invention, it will be appreciated that there are numerous alternatives and modifications to the partition feeding procedure which are readily apparent from the foregoing.

For example, the partition feeder may be readily adapted to handling different configurations of bottle groups or pitches in numbers of partitions. For example, the apparatus could be utilized to insert three partitions between the bottles in four rows of a group or pitch extending across the conveyor. In addition, the feeder could handle a varied number of pitches per minute for either one, two or three partitions being fed into each pitch of bottles.

Such changes can be accomplished, for example, by attention to the cam profile, the lug spacing on the feed chain and the shape, if necessary, of the tab plows or folders for converting the flat partitions to partitions with foldout tabs.

Also, it will be appreciated that if desired, the feeder 14 could be operated to deposit partitions onto the chain conveyor 12 in a sequential fashion of even spacing with the first partition simply lying under the feeder until engaged by a leading lug 20, for example, just prior to the deposit of a second partition. It is therefore only necessary to match the partition feed overall output with the number of pitches and the speed thereof on conveyor 23.

With respect to the cam 70 and the track 71, it will be appreciated that the track 71 can be designed by any conventional cam design techniques where the cam is utilized to deliver two partitions, as illustrated and described above, for example. The cam is designed such that the traveling outlet or discharge end 79 is movable into an indexable position with a first gap "G-1" between the first and second bottle rows during a set time in which a partition can be fed. After feeding, the cam is shaped so as to withdraw or return the discharge outlet 79 to a position where it can index with the following gap "G-2" and then move therealong with the gap "G-2", during which time a second partition can be fed.

It will be appreciated that it is also possible to utilize a three partition cam accomplishing the feeding of three partitions in a bottle pitch, for example, during one cam revolution. In this regard, the profile of the track 71 could be changed to accomplish this motion as well, all of such motions obtaining a longer duration of indexed position between discharge outlet 79 and the target gap, so as to increase the time that the discharge outlet is in operative alignment with the gap and thereby allow sufficient time for the adequate feeding of partitions.

It will also be appreciated that a cam sufficient for feeding three partitions could also be utilized to feed two partitions, simply by changing the feeding operation of the orbital feeder, for example, and only depositing two partitions, such as in a leading and single trailing lug, rather than in a third trailing lug, which will be utilized for a third partition. This could be accomplished, for example, with a particular orbital feeder described in the aforesaid U.S. Patents simply by turning off one of the suction cups.

It will also be appreciated that partitions can be fed during the rearward movement of the discharge outlet 79 as it begins and returns to a position where it an index with a following gap. Thus, it will be appreciated that the duration of the time during which a partition can be fed includes both the time that the discharge nip 79 moves along with the gap in the machine direction and during the time that the outlet 79 still remains indexed with that gap and as it returns.

It will also be appreciated that while the apparatus described above can be utilized for feeding partitions to different configurations of bottle groups and pitches, for example, and at many different speeds. The apparatus is particularly useful for higher speed operations where the feeder is utilized to feed partitions between bottle rows emanating from a high speed bottling operation of say, for example, 1800 bottles per minute, wherein 12 bottles are grouped in each pitch, and thereby producing a pitch output of about 150 pitches per minute.

Accordingly, the feeder is operable to insert 300 or 450 different partitions per minute, depending on the number of bottle rows in each pitch.

It will also be appreciated that while cam 70 and cam track 71, operating together with a lever 72 and arm 78, have been described to drive the traveling partition outlet 79, the traveling feeder 11 could be driven by any suitable means, such as a variety of cranks and cams or servo motors or other motor or solenoid or proportional devices which could be programmed or oriented to produce the desired indexable movement of the outlet 79 with the traveling gaps in the bottle pitches.

The motion of the discharge end or outlet 79 is thus used to follow an insertion point for a time period simply long enough to insert the particular partition.

Accordingly, it will be appreciated that, in addition to the high speed operation of the partition feeder as described, it is only necessary to utilize a single magazine and single feeder of partitions and that center dividers in a carton are no longer necessary.

It will also be appreciated that since the partitions are stretched across the conveyor in a transverse orientation, that the length of each of the partitions is approximately equal to four bottle diameters. Where there are 12 bottles in a three row by four bottle configuration then, the total length of the partition material necessary is essentially equal to only eight bottle diameters. This is to be contrasted, for example, to a partition feeding operation where the partitions are fed in a plane in parallel with the machine direction or the longitudinal direction of the conveyor and the partitions are inserted between the bottles of the respective rows. Since there are four bottles abreast in the configuration as described herein, such an operation would require three partitions, each one being the length of approximately three bottle diameters. Alternately, such operation would require two partitions and a specially constructed carton having an internal folding panel or divider that serves as the third partition. Thus, the total partition material needed for feeding longitudinal partitions would be equivalent to approximately nine bottle diameters and thus the feeding of partitions transversely as described herein results in a material savings in partition material of over ten percent.

These and other advantages and modifications will be readily appreciated from the foregoing description of a preferred embodiment of the invention without departing from the spirit of the invention and the applicant intends to be bound only by the claims appended hereto:

What is claimed is:

1. Apparatus for feeding partitions between conveyed items and comprising:

a traveling feed nip for receiving partitions and for feeding partitions between rows of said items, said feed nip having a traveling partition outlet end oscillating in timed relation with gaps between portions of said items moving in successive rows in a downstream direction.

2. Apparatus as in claim 1 wherein said partitions are fed in a plane transverse to said downstream direction.

3. Apparatus as in claim 2 wherein said traveling feed nip includes at least two counter rotating members feeding a partition therebetween, said members traveling together in a downstream direction as said partition outlet end moves with said gap.

4. Apparatus as in claim 3 including a cam for driving said members and said outlet in a direction parallel to said downstream direction and in part in time with a gap between said items.

5. Apparatus as in claim 4 wherein said counter rotating members are opposed belts carried on respective separate sets of rollers, the sets of rollers being mounted on a frame, each frame pivoted at an upper end and a lower end of each frame further defining the traveling partition outlet end.

6. Apparatus as in claim 4 including a feed conveyor for feeding partitions to said nip, said conveyor having partition feeding lugs thereon spaced to carry partitions to said nip in timed relation to gaps between items and to gaps between groups of items.

7. Apparatus as in claim 6 further comprising a partition magazine and a rotary picker for stripping partitions for said magazine and for depositing stripped partitions on said feed conveyor at equal timed intervals, wherein lugs on said conveyors are spaced to pick up groups of partitions spaced within each group in relation to gaps between items and between each group in relation to spaces between groups of items.

8. Apparatus as in claim 2 wherein said traveling feed nip comprises two counter rotating belts, each mounted on a respective frame pivoted at its upper end and wherein said lower ends are connected for translation together in a direction parallel to said downstream direction.

9. Apparatus as in claim 8 further including a cam, a cam follower, and a lever attached to said cam follower and to said frames for driving said partition outlet end of said nip.

10. Apparatus as in claim 9 further including an adjustable length arm interconnected between said lever and said frames for adjusting the position of said outlet end of said nip as a function of said cam and cam follower.

11. Apparatus for feeding partitions between rows of bottles in pitches on a moving conveyor wherein said partitions are fed in a plane substantially transverse to a direction of movement of said conveyor, said apparatus comprising:

a traveling partition feed nip including frame members pivoted at an upper end and having a lower discharge end oscillating in said conveyor direction and in a reverse direction, and said discharge end being oscillated in part in timed relation with gaps between portions of bottles in respective rows for feeding a partition into said gaps and between rows of bottles as said rows move in a downstream direction.

12. Apparatus as in claim 11 further including a cam interconnected with said feed nips for indexing said discharge end with a gap as said gap moves downstream.

13. Apparatus as in claim 12 wherein said cam shape is a function of said gaps and said pitches of bottles.

14. Apparatus as in claim 13 wherein said cam has a profile for indexing said discharge end of said nip in operable relation with at least two gaps in each pitch of bottle rows.

15. Apparatus as in claim 11 wherein there are more bottles in each row across said conveyor than there are rows in each pitch along said conveyor, and wherein a partition is fed between each row in a pitch.

16. Apparatus as in claim 11 further including means for indexing said discharge end of said nip along with a traveling gap in a downstream direction.

17. A method of feeding partitions between rows of bottles oriented transversely across a conveyor and including the steps of:

conveying rows of bottles in a downstream direction, said rows oriented transversely to the direction;

indexing a moving partition outlet with a gap between portions of bottles in two respective rows of bottles;

moving the outlet in a downstream direction while aligned with said gap;

feeding a partition from said outlet into said gap and between said two rows of bottles;

and oscillating said outlet to a position for indexing with a following gap between a row of bottles.

18. A method as in claim 17 further including the step of moving the outlet with said following gap and feeding a partition between rows of bottles defining said gap.

19. A method as in claim 18 further including the step of feeding partitions to said outlet from a partition conveyor and feeding partitions onto said conveyor from a single magazine.

20. A method as in claim 19 including the step of feeding partitions onto said conveyor at equal time intervals and conveying said partitions toward said outlet in groups with partitions in each group oriented on said conveyor more closely together than the groups on the conveyor.

21. A method as in claim 20 including the step of bending bottle separating tabs out of the plane of said partitions while said partitions are conveyed on said conveyor.

22. A method as in claim 18 including the step of oscillating said outlet to deposit two partitions with a single rotation of a cam track connected to move said outlet.

23. A method of feeding partitions between adjacent rows of bottles comprising the steps of:

feeding partitions successively to at least one oscillating feed nip having an oscillating outlet end;

conveying transverse rows of bottles in a downstream direction;

feeding a partition between two transverse rows of bottles from said outlet end while said oscillating outlet end moves downstream;

reversing the direction of movement of oscillating outlet end to an upstream direction;

thereafter reversing direction of movement of said oscillating outlet end to a downstream direction; and feeding another partition between succeeding rows of bottles.

24. A method of feeding partitions between rows of bottles, said method comprising the steps of:

continuously conveying transverse rows of bottles in a downstream direction;

moving an outlet end of a traveling partition feeding nip in a downstream direction from a starting position over a first distance and feeding a partition from said outlet end between two rows of bottles;

reversing direction of said nip and outlet end to an upstream direction over a distance less than said first distance;

again reversing direction of said nip to a downstream direction and feeding another partition from said outlet between two rows of bottles; and thereafter returning said outlet end to said starting position.

25. A method of feeding partitions between transverse rows of bottles comprising the steps of:

conveying transverse rows of bottles in a downstream direction;

oscillating a traveling partition feed nip having a partition outlet end through a cycle including feeding at least one partition between two moving rows of bottles from an outlet end of said nip moving along a downstream path and reversing the direction of movement of said outlet end in a reverse direction along said path preparatory to another downstream movement and another partition insertion.

26. Apparatus for feeding partitions between rows of bottles and comprising:

a traveling nip comprising two counter rotating members for receiving a partition and for feeding a partition between rows of bottles from a traveling outlet end;

a nip drive moving said outlet end in timed relation with a gap between at least portions of bottles in two adjacent, moving, transverse rows of bottles; and said nip having an oscillating outlet end feeding partitions between rows of bottles where said outlet end is operable aligned to feed a partition between said rows.

* * * * *